US009351375B2

(12) United States Patent
Hung

(10) Patent No.: US 9,351,375 B2
(45) Date of Patent: May 24, 2016

(54) ADAPTIVE LIGHTING SYSTEM WITH LOW ENERGY CONSUMPTION

(75) Inventor: Po-Chieh Hung, Cupertino, CA (US)

(73) Assignee: KONICA MINOLTA LABORATORY U.S.A., INC., San Mateo, CA (US)

( * ) Notice: Subject to any disclaimer, the term of this patent is extended or adjusted under 35 U.S.C. 154(b) by 212 days.

(21) Appl. No.: 14/009,034

(22) PCT Filed: Mar. 31, 2011

(86) PCT No.: PCT/US2011/030628

§ 371 (c)(1),
(2), (4) Date: Sep. 30, 2013

(87) PCT Pub. No.: WO2012/134467

PCT Pub. Date: Oct. 4, 2012

(65) Prior Publication Data

US 2014/0077705 A1 Mar. 20, 2014

(51) Int. Cl.

| | |
|---|---|
| ***H05B 39/04*** | (2006.01) |
| ***H05B 37/02*** | (2006.01) |
| ***H05B 33/08*** | (2006.01) |

(52) U.S. Cl.

CPC ..... *H05B 37/0227* (2013.01); *H05B 33/0845* (2013.01); *H05B 33/0872* (2013.01); *H05B 33/0896* (2013.01)

(58) Field of Classification Search

CPC ..... H05B 39/04
See application file for complete search history.

(56) References Cited

U.S. PATENT DOCUMENTS

| | | | | |
|---|---|---|---|---|
| 7,772,787 | B2 | 8/2010 | Ashdown et al. | |
| 7,796,034 | B2 | 9/2010 | Laski et al. | |
| 8,941,308 | B2 * | 1/2015 | Briggs | H05B 37/0218 315/149 |
| 2008/0105887 | A1 | 5/2008 | Narendran et al. | |
| 2010/0110672 | A1 | 5/2010 | Durand et al. | |

OTHER PUBLICATIONS

Office action in counterpart Chinese Patent Application No. 201180069777.8 issued on Aug. 4, 2014 (15 pages).
International Search Report issued in PCT/US2011/030828 mailed on May 25, 2011 (1 page).
Written Opinion of the International Searching Authority issued in PCT/US2011/030628 mailed on May 25, 2011 (16 pages).

* cited by examiner

*Primary Examiner* — Hai L Nguyen
(74) *Attorney, Agent, or Firm* — Osha Liang LLP

(57) ABSTRACT

A method for designing a lighting system, including: obtaining a selection of a color temperature (CT); obtaining, for the CT, a first spectral power distribution (SPD) corresponding to a low value color rendering index (CRI) and having a first plurality of peak wavelengths; obtaining, for the CT, a second SPD corresponding to a high value CRI and having a second plurality of peak wavelengths; and identifying a plurality of common peak wavelengths shared by the first SPD and the second SPD, where the lighting system includes a first plurality of light sources corresponding to the plurality of common peak wavelengths and a second plurality of light sources corresponding to a plurality of remaining peak wavelengths of the second plurality of peak wavelengths, and where the lighting system activates the second plurality of light sources in response to an event.

20 Claims, 8 Drawing Sheets

| | MLS A | SLS A | MLS B | SLS B | TOTAL |
|---|---|---|---|---|---|
| ESM | 19.9 | 0.0 | 113.5 | 0.0 | 133.4 |
| FPM | 19.0 | 44.9 | 28.9 | 68.1 | 161.0 |

| | MLS A | SLS A | MLS B | SLS B | TOTAL |
|---|---|---|---|---|---|
| ESM | 62.7 | 0.0 | 102.1 | 0.0 | 164.9 |
| FPM | 60.6 | 57.6 | 31.2 | 463.8 | 196.2 |

ADAPTIVE LIGHTING SYSTEM WITH LOW ENERGY CONSUMPTION

BACKGROUND

Lighting is the deliberate application of light to achieve some aesthetic or practical effect. Lighting may include the use of both artificial light sources (e.g., lamps) and/or natural light sources (e.g., the sun). Artificial lighting represents a major component of energy consumption, accounting for a significant part of all energy consumed worldwide.

It is becoming increasing important to reduce energy consumption. This applies to many sectors including lighting. However, while proper lighting can enhance task performance, aesthetics, mood, well-being, etc., poor lighting may cause adverse health effects in addition to multiple other problems. Accordingly, while it is important the energy consumed by lighting systems be reduced, it is also fairly important that this energy consumption reduction not drastically impact illuminance.

SUMMARY OF INVENTION

In general, in one aspect, the invention relates to a method for designing a lighting system. The method comprises: obtaining a selection of a color temperature (CT); obtaining, for the CT, a first spectral power distribution (SPD) corresponding to a low value color rendering index (CRI) and comprising a first plurality of peak wavelengths; obtaining, for the CT, a second SPD corresponding to a high value CRI and comprising a second plurality of peak wavelengths; and identifying a plurality of common peak wavelengths shared by the first SPD and the second SPD, wherein the lighting system comprises a first plurality of light sources corresponding to the plurality of common peak wavelengths and a second plurality of light sources corresponding to a plurality of remaining peak wavelengths of the second plurality of peak wavelengths, and wherein the lighting system activates the second plurality of light sources in response to an event.

In general, in one aspect, the invention relates to a non-transitory computer readable storage medium storing instructions for designing a lighting system. The instructions comprising functionality to obtain a selection of a color temperature (CT); obtain, for the CT, a first spectral power distribution (SPD) corresponding to a low value color rendering index (CRI) and comprising a first plurality of peak wavelengths; obtain, for the CT, a second SPD corresponding to a high value CRI and comprising a second plurality of peak wavelengths; and identify a plurality of common peak wavelengths shared by the first SPD and the second SPD, wherein the lighting system comprises a first plurality of light sources corresponding to the plurality of common peak wavelengths and a second plurality of light sources corresponding to a plurality of remaining peak wavelengths of the second plurality of peak wavelengths, and wherein the lighting system activates the second plurality of light sources in response to an event.

In general, in one aspect, the invention relates to a method for controlling light sources. The method comprises activating a first plurality of light sources corresponding to a first plurality of peak wavelengths; detecting an event; and activating, in response to detecting the event, a second plurality of light sources corresponding to a second plurality of peak wavelengths, wherein the first plurality of peak wavelengths are common peak wavelengths shared by a first spectral power distribution (SPD) corresponding to a low value color rendering index (CRI) and a second SPD corresponding to a high value CRI, wherein the first SPD and the second SPD are for the same color temperature (CT), and wherein the second SPD comprises the first plurality of peak wavelengths and the second plurality of peak wavelengths.

In general, in one aspect, the invention relates to lighting system. The lighting system comprises a first plurality of light sources corresponding to a first plurality of peak wavelengths; a second plurality of light sources corresponding to a second plurality of peak wavelengths; and a controller unit configured to activate the first plurality of light sources and further configured to activate the second plurality of light sources in response to an event, wherein the first plurality of peak wavelengths are common peak wavelengths shared by a first spectral power distribution (SPD) corresponding to a low value color rendering index (CRI) and a second SPD corresponding to a high value CRI, wherein the first SPD and the second SPD are for the same color temperature (CT), and wherein the second SPD comprises the first plurality of peak wavelengths and the second plurality of peak wavelengths.

Other aspects of the invention will be apparent from the following description and the appended claims.

DETAILED DESCRIPTION

Figure 1:
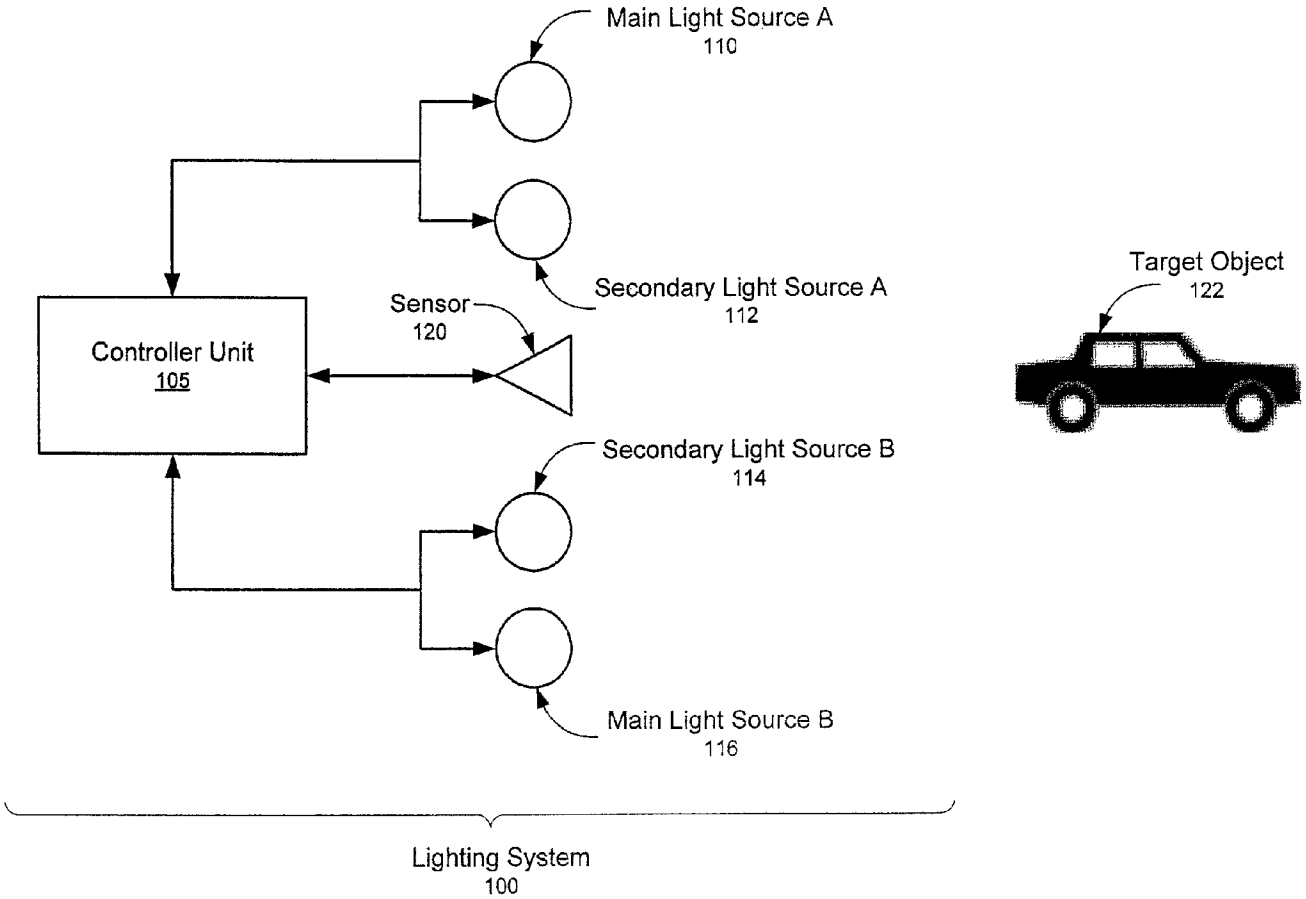
FIG. 1 shows a block diagram depicting a lighting system in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention provide a system and method for designing and operating a lighting system for a selected color temperature (CT). The lighting system operates in various modes including an energy saving mode (ESM) and a full performance mode (FPM). In the ESM, only the main light sources of the lighting system are activated. In the FPM, both the main light sources and the secondary light sources of the lighting system are activated. The spectral power distribution (SPD) of the light emitted in the ESM and the SPD of the light emitted in FPM share common peak wavelengths. The SPD for the ESM has a high luminous efficacy of radiation (LER) but corresponds to a low value color rendering index (CRI). In contrast, the SPD for the FPM has a smaller LER but a high value CRI. Energy consumed by the light system is reduced by operating in the ESM until an event triggers the need for the FPM.

FIG. 1 shows a lighting system (100) in accordance with one or more embodiments of the invention. As shown in FIG. 1, the lighting system (100) has multiple components including a controller unit (105), a sensor (120), one or more main light sources (i.e., Main Light Source A (110), Main Light Source B (116)), and one or more secondary light sources (i.e., Secondary Light Source A (112), Secondary Light Source B (116)). There may be direct connections between the controller unit (105), the sensor (120), and the light sources (110, 112, 114, 116). Alternatively, one or more of the controller unit (105), the sensor (120), and the light sources (110, 112, 114, 116) may be connected using a network (not shown) having wired and/or wireless segments. In one or more embodiments of the invention, the sensor (120) is optional.

In one or more embodiments of the invention, the lighting system (100) is used to illuminate a target object (122). The target object (122) may be a physical object of any size and shape. Further, the lighting system (100) may illuminate the target object (122) in any location, including indoors, outdoors, underwater, behind glass or plastic, in reduced oxygen environments, etc. Further still, the target object (122) may be a room, a hallway, a tunnel, a parking lot, etc.

In one or more embodiments of the invention, the lighting system (100) is configured to operate in multiple modes. For example, the lighting system (100) may operate in an ESM and a FPM, where the ESM consumes less energy than the FPM. In the ESM, only the main light sources (110, 116) are activated (i.e., turned-on). In the FSM mode, the main light sources (110, 116) and the secondary light sources (112, 114) are activated. The lighting system (100) may switch directly from the ESM to the FSM and/or directly from the FSM to the ESM. Alternatively, there may be one or more intermediate modes between ESM and FSM that are invoked during the progression between ESM and FSM. Further, the main light sources (110, 116) and/or secondary light sources (112, 114) may correspond to any combination of light emitting diodes (LEDs), lasers, organic light emitting diodes (OLEDs), OLEDs with quantum dots, microcavities, interference filters, gratings, prisms, etc.

In one or more embodiments of the invention, the controller unit (105) is configured to switch the lighting system (100) between the multiple modes (i.e., ESM, FPM). In other words, the controller unit (105) is configured to switch/change the lighting system (100) mode by activating and/or deactivating the main light sources (110, 116) and/or the secondary light sources (112, 114). The controller unit may also be configured to set/adjust the relative powers of the main light sources (110, 116) and/or the secondary light sources (112, 114) in all modes of operation.

In one or more embodiments of the invention, the controller unit (105) changes the mode of the lighting system (100) in response to an event. The event may be the timeout of a timer (not shown) within or external to the controller unit (105), an instruction from a user, the detection of motion by the sensor (120), the detection of noise/sound/vibration by the sensor (120), the detection of a temperature change or atmospheric pressure change by the sensor (120), etc.

In one or more embodiments of the invention, the controller unit (105) is a computing device configurable by a user. Accordingly, the controller unit (105) may be a personal computer (PC), a desktop computer, a mainframe, a server, a telephone, a kiosk, a cable box, a personal digital assistant (PDA), an electronic reader, a mobile phone, a smart phone, etc. Further, although FIG. 1 shows a single controller unit (i.e., Controller Unit (105)) and a single sensor (i.e., Sensor (120)) for all of the light sources (110, 112, 114, 116), alternative embodiments of the invention may include multiple controller units and/or sensors. For example, in alternative embodiments of the invention, there may be a controller unit for each light source (110, 112, 114, 116).

Those skilled in the art, having the benefit of this detailed description, will appreciate that CT is a characteristic of visible light that has important applications in lighting, photography, publishing, manufacturing, astrophysics, and other fields. In one or more embodiments of the invention, the lighting system (100) is designed to emit light of a selected CT. The CT may be selected based on the preferences of those viewing, or expected to view, the target object (122). Further, the CT may be selected as any value (e.g., 2856K, 4000K, 5000K, 6500K, 10000K, etc.) from any range of values.

Those skilled in the art, having the benefit of this detailed description, will appreciate that the CRI is a quantitative measure of the ability of a light source (e.g., the light emitted by the lighting system (100)) to reproduce colors of various objects (e.g., target object (122)) faithfully in comparison with an ideal or natural light source. Further, those skilled in the art, having the benefit of this detailed description, will also appreciate that the LER measures the fraction of electromagnetic power (i.e., the light emitted by the lighting system (100)) which is useful for lighting. The LER has a maximum possible value of 683 lm/W.

In one or more embodiments of the invention, each operating mode (e.g., ESM, FPM) of the lighting system (100) is designed to emit light having a different spectral power distribution (SPD) for the selected CT. In other words, the light sources (110, 112, 114, 116) are selected to produce a predetermined SPD for the EMS and a pre-determined SPD for the FPM.

In one or more embodiments of the invention, the SPD for the ESM is designed to have a high (potentially maximum) LER for the selected CT, but at the cost of the CRI (i.e., a low value CRI). Such a SPD may be spiky with multiple peak wavelengths. In contrast, the SPD for the FPM is designed to target a high value CRI (e.g., 80 or higher). However, the tradeoff for this high value CRI is a SPD with a smaller LER. Such a SPD may also be spiky with multiple peak wavelengths. In one or more embodiments of the invention, both the SPD for the ESM and the SPD for the FPM produce a similar illuminance. The number (i.e., cardinality) of peak wavelengths in the SPD for the FPM exceeds the number (i.e., cardinality) of peak wavelengths in the SPD for the ESM.

In one or more embodiments of the invention, the SPD for the ESM and the SPD for the FPM have common peak wavelengths. Each of the main light sources (110, 116) corresponds to one of the common peak wavelengths. In other words, each of the main light sources (110, 116) emits a common peak wavelength or a wavelength within a small range (i.e., 30 nm) of a common peak wavelength. In one or more embodiments of the invention, the peak wavelengths of the SPD for the FPM, which are not common peak wavelengths, are referred to as remaining peak wavelengths. In one or more embodiments of the invention, each of the secondary light sources (112, 114) corresponds to one of the remaining peak wavelengths. In other words, each of the secondary light sources (112, 114) emits a remaining peak wavelength or a wavelength within a small range (i.e., 30 nm) of a remaining peak wavelength.

In one or more embodiments of the invention, peak wavelengths in the SPD for the ESM and peak wavelengths in the SPD for the FPM need not be identical to be considered common peak wavelengths. In other words, a peak wavelength in the SPD for the ESM and a peak wavelength in the SPD for the FPM may differ by a small range (e.g., 50 nm)

and still be referred to as common peak wavelengths. In such embodiments, a main light source (110, 116) emits one of the two peak wavelengths or a wavelength within a small range of one of the two peak wavelengths.

Figure 2A:
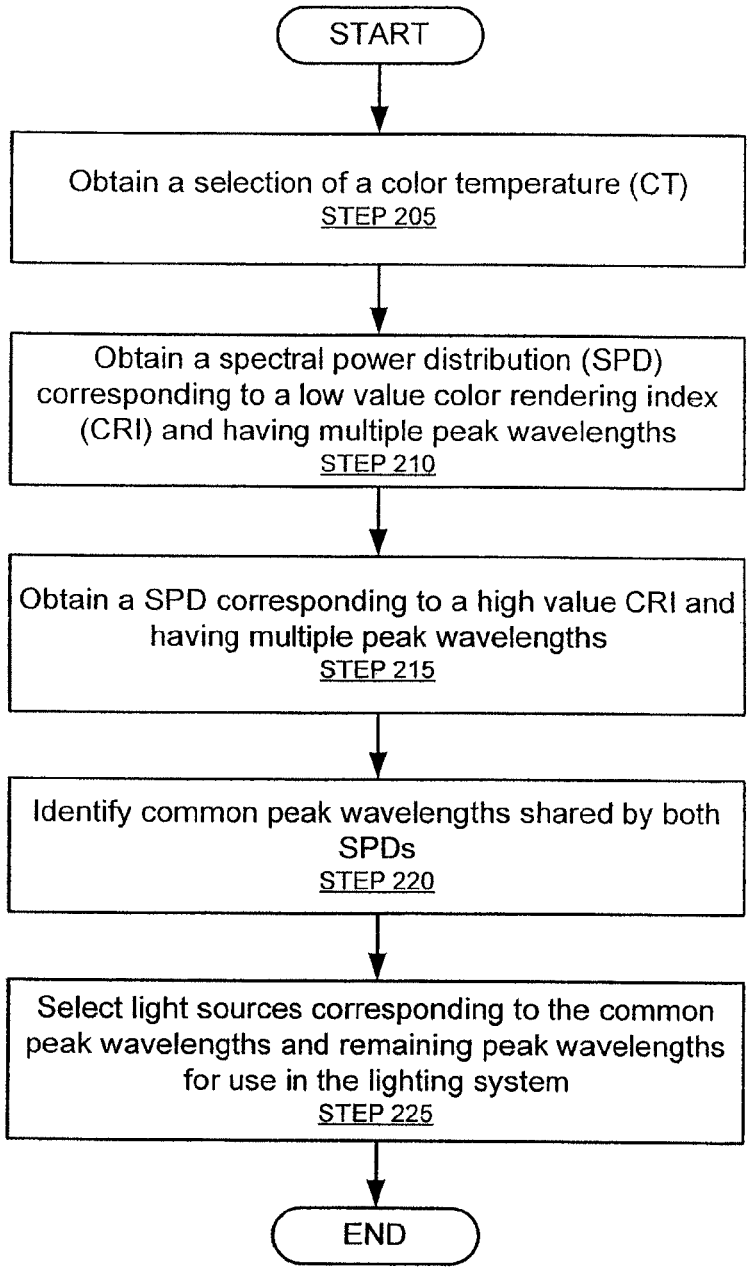
FIGS. 2A, 2B, and 2C show flowcharts in accordance with one or more embodiments of the invention.

FIG. 2A shows a flowchart in accordance with one or more embodiments of the invention. The process shown in FIG. 2A may be used to design a lighting system (i.e., Lighting System (100), discussed above in reference to FIG. 1). One or more steps shown in FIG. 2A may be omitted, repeated, and/or performed in a different order among different embodiments of the invention. Accordingly, embodiments of the invention should not be considered limited to the specific number and arrangement of steps shown in FIG. 2A.

Initially, a selection of a color temperature (CT) is obtained (STEP 205). As discussed above, CT is a user preference and is selected based on the audience expected to view a target object (e.g., Target Object (122), discussed above in reference to FIG. 1). Further, the CT may be selected as any value (e.g., 2856K, 4000K, 5000K, 6500K, 10000K, etc.) from any range of values.

In STEP 210, a SPD having a high (potentially maximum) LER for the CT is obtained. The tradeoff for this high LER may be a low value CRI. In one or more embodiments of the invention, the SPD is spiky with multiple peak wavelengths. The lighting system will be designed to emit, approximately, this SPD in an ESM.

In STEP 215, a SPD corresponding to a high value CRI (e.g., 80 or higher) for the CT is obtained. The tradeoff for this high value CRI may be a reduced LER. In one or more embodiments of the invention, the SPD is spiky with multiple peak wavelengths. The lighting system will be designed to emit, approximately, this SPD in a FPM. Further, this SPD will have a greater number of peak wavelengths than the number of peak wavelengths in the SPD obtained in STEP 210.

In STEP 220, common peak wavelengths shared by the SPD obtained in STEP 210 and the SPD obtained in STEP 215 are identified. In one or more embodiments of the invention, peak wavelengths in the two SPDs need not be identical to be considered common peak wavelengths. In other words, a peak wavelength in the SPD from STEP 210 and a peak wavelength in the SPD from STEP 215 may differ by a small range (e.g., 50 nm) and still be referred to as common peak wavelengths. In one or more embodiments of the invention, the peak wavelengths in the SPD from STEP 215, which are not common peak wavelengths, are referred to as remaining peak wavelengths.

In STEP 225, light sources corresponding to the common peak wavelengths are selected for the lighting system (e.g., Lighting System (100), discussed above in reference to FIG. 1). In other words, for each common peak wavelength identified, a light source (e.g., Main Light Source A (110), Main Light Source B (116), discussed above in reference to FIG. 1) emitting the common peak wavelength or a wavelength within a small range of the common peak wavelength is selected for use in the lighting system. Similarly, light sources corresponding to the remaining peak wavelengths are selected for the lighting system. In other words, for each remaining peak wavelength, a light source (e.g., Secondary Light Source A (112), Secondary Light Source B (114), discussed above in reference to FIG. 1) emitting a remaining peak wavelength or a wavelength within a small range of the remaining peak wavelength is selected for use in the lighting system.

As discussed above, the lighting system will operate in various modes. In the ESM, the light sources of the lighting system corresponding to the common peak wavelengths are activated. In FPM, the light sources corresponding to the common peak wavelengths and the light sources corresponding to the remaining peak wavelengths are activated. As also discussed above, the lighting system may switch from ESM to FPM and/or from FPM to ESM. In one or more embodiments of the invention, the trigger for the switch is a timer timeout, detection of motion, detect of noise, etc.

Figure 2B:
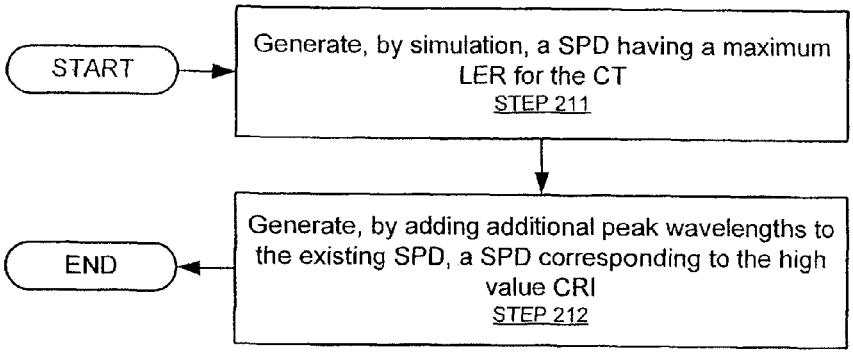

FIG. 2B shows a flowchart in accordance with one or more embodiments of the invention. The process shown in FIG. 2B may be used to obtain one or more SPDs (i.e., STEP 210 and/or STEP 215, discussed above in reference to FIG. 2A). In other words, a CT may have already been selected before the process in FIG. 2B is executed. One or more steps shown in FIG. 2B may be omitted, repeated, and/or performed in a different order among different embodiments of the invention. Accordingly, embodiments of the invention should not be considered limited to the specific number and arrangement of steps shown in FIG. 2B.

Initially, a SPD having a maximum LER for the selected CT is generated via simulation (e.g., using the non-linear optimization function of a spreadsheet) (STEP 211). In other words, the SPD is generated by attempting to maximize LER for the CT, regardless of CRI (i.e., the SPD shape is a free variable). In one or more embodiments of the invention, the resulting SPD is spiky and has multiple peak wavelengths. Further, this SPD may correspond to the SPD obtained in STEP 210 in FIG. 2A.

In STEP 212, a SPD corresponding to a target high value CRI is generated via simulation. Specifically, in order to generate this SPD, additional peak wavelengths are added to the SPD of STEP 211, and the relative power(s) of the existing peak wavelengths in the SPD of STEP 211 are adjusted until the target high value CRI is achieved (at the potential cost of a reduced LER). Accordingly, this SPD and the SPD of STEP 211 will have common peak wavelengths. Further, this SPD may correspond to the SPD obtained in STEP 215 of FIG. 2A.

Those skilled in the art, having the benefit of this detailed description, will appreciate that there may exist other SPD shapes to achieve the highest LER for the target high value CRI. However, it is not easy to prove the solution is unique because of the problem's non-linear nature.

Figure 2C:
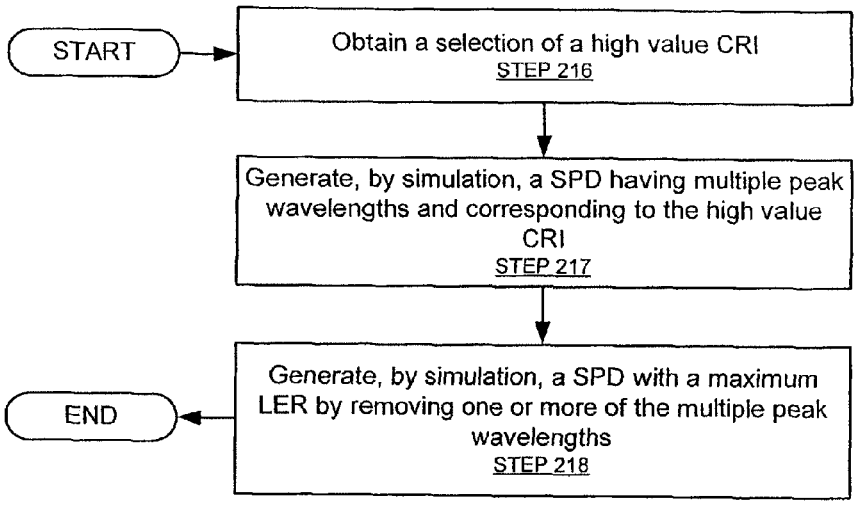

FIG. 2C shows a flowchart in accordance with one or more embodiments of the invention. The process shown in FIG. 2C may be used to obtain one or more SPDs (i.e., STEP 210 and/or STEP 215, discussed above in reference to FIG. 2A). In other words, a CT may have already been selected before the process in FIG. 2C is executed. One or more steps shown in FIG. 2C may be omitted, repeated, and/or performed in a different order among different embodiments of the invention. Accordingly, embodiments of the invention should not be considered limited to the specific number and arrangement of steps shown in FIG. 2C.

Initially, a selection of a high value CRI is obtained (STEP 216). The selected CRI is a user preference and corresponds to a quantitative measure of the ability of a light source to reproduce colors of various objects faithfully in comparison with an ideal or natural light source. In one or more embodiments, the high value CRI is 80 or more.

In STEP 217, a SPD corresponding to the selected high value CRI is generated through simulation. In one or more embodiments of the invention, this SPD will be spiky and have multiple peak wavelengths. This SPD may correspond to the SPD obtained in STEP 215 of FIG. 2A.

Those skilled in the art, having the benefit of this detailed description, will appreciate that it may not be possible to generate a spiky SPD for the selected high value CRI and the CT. In other words, the user may need to select an alternative target high value CRI.

In STEP 218, a SPD having a maximum LER for the CT is generated by removing one or more of the peak wavelengths from the SPD of STEP 217 and/or changing the relative power(s) of one or more of the peak wavelengths in the SPD of STEP 217. In one or more embodiments of the invention, the lighting system may need an auxiliary light source to adjust chromaticity. This SPD may correspond to the SPD obtained in STEP 210 of FIG. 2A.

Those skilled in the art, having the benefit of this detailed description, will appreciate that the process described in FIG. 2B generates a SPD for the ESM of the lighting system and then generates a SPD for the FPM using one or more of the peak wavelengths in the SPD for the ESM. In contrast, the process in FIG. 2C generates a SPD for the FPM of the lighting system and then generates a SPD for the ESM using one or more peak wavelengths in the SPD for the FPM. In one or more embodiments of the invention, the SPD for the ESM and the SPD for the FPM are generated (e.g., using the non-linear optimization function of a spreadsheet) independently of each other (i.e., one SPD is not built from the other SPD). In such embodiments, peak wavelengths in the SPD for the ESM and peak wavelengths in the SPD for the FPM need not be identical to be considered common peak wavelengths. In other words, a peak wavelength in the SPD for the ESM and a peak wavelength in the SPD for the FPM may differ by a small range (e.g., 50 nm) and still be referred to as common peak wavelengths.

Figure 3:
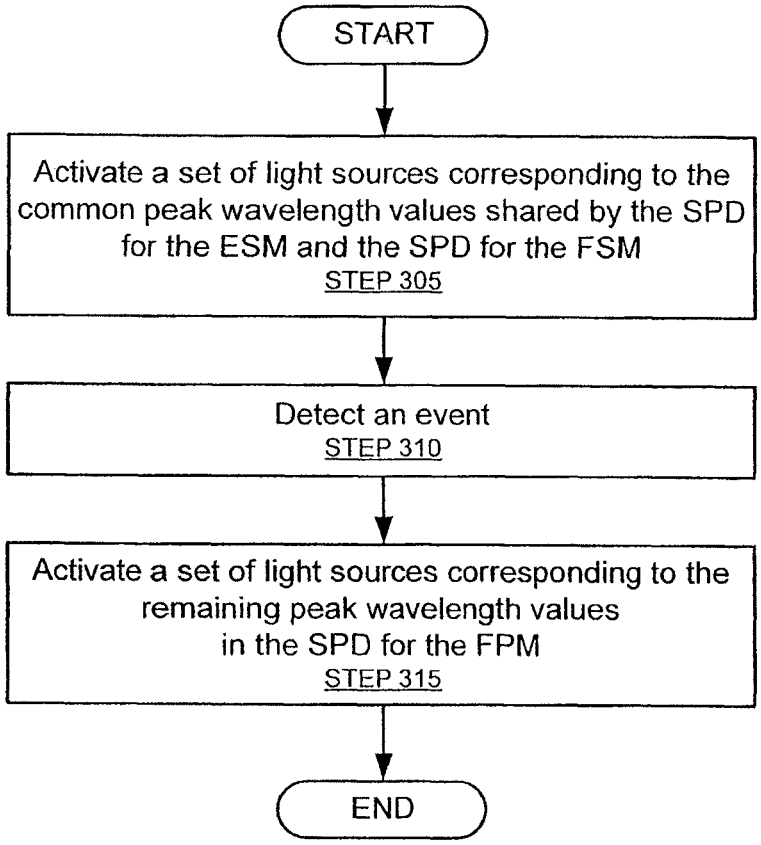
FIG. 3 shows a flowchart in accordance with one or more embodiments of the invention.

FIG. 3 shows a flowchart in accordance with one or more embodiments of the invention. The process shown in FIG. 3 may be used to operate a lighting system (i.e., Lighting System (100), discussed above in reference to FIG. 1). In other words, the process described in FIG. 3 may be executed after the lighting system is designed and build (i.e., after STEP 225 in FIG. 2A). One or more steps shown in FIG. 3 may be omitted, repeated, and/or performed in a different order among different embodiments of the invention. Accordingly, embodiments of the invention should not be considered limited to the specific number and arrangement of steps shown in FIG. 3.

Initially, a set of light sources corresponding to the common peak wavelength values shared by the SPD for the ESM and the SPD for the FPM of the lighting system are activated (STEP 305). As discussed above, the SPD for the ESM corresponds to a low value CRI, while the SPD for the FPM corresponds to a high value CRI. Further, this set of light sources may be referred to as the main light sources (i.e., Main Light Source A (110), Main Light Source B (116), discussed above in reference to FIG. 1) of the lighting system. Further still, this set of light sources may be activated with the relative powers dictated by the SPD for the ESM. Moreover, this set of light sources may be any combination of light emitting diodes (LEDs), lasers, organic light emitting diodes (OLEDs), OLEDs with quantum dots, microcavities, interference filters, gratings; prisms, etc.

In STEP 310, an event is detected. The event may correspond to a timer timeout. Alternatively, the event may correspond to motion, noise, a temperature change, etc. that has been detected by a sensor. The sensor may either be part of the light system or connected to the light system.

In STEP 315, a set of light sources corresponding to the remaining peak wavelengths in the SPD for the FPM are activated. This set of light sources is activated in addition to the set of light sources corresponding to the common peak wavelengths. This set of light sources may be referred to as the secondary light sources (i.e., Secondary Light Source A (112), Secondary Light Source B (114), discussed above in reference to FIG. 1) of the lighting system. Further still, the relative powers of both this set of light sources and the set of light sources in STEP 305 may be set as dictated by the SPD for the FPM. Moreover, this set of light sources may be any combination of light emitting diodes (LEDs), lasers, organic light emitting diodes (OLEDs), OLEDs with quantum dots, microcavities, interference filters, gratings, prisms, etc.

Those skilled in the art, having the benefit of this detailed description, will appreciate that the process shown in FIG. 3 switches the lighting system from the ESM (i.e., STEP 305) to the FPM (i.e., STEP 315) in response to an event (i.e., 310). In alternative embodiments of the invention, the lighting system may switch from the FPM (i.e., STEP 315) to the ESM (i.e., STEP 305) in response to an event. In such embodiments, switching from the lighting system from the FPM to the ESM includes deactivating the secondary light sources while keeping the main light sources activated, but potentially adjusting the relative power(s) of the main light source as dictated by the SPD of the ESM. Further, the switch from ESM to FRM may not be a simple switch. In other words, there may exist one or more intermediate modes between ESM and FMS that are invoked during the progression between ESM and FMS.

Figure 4A:
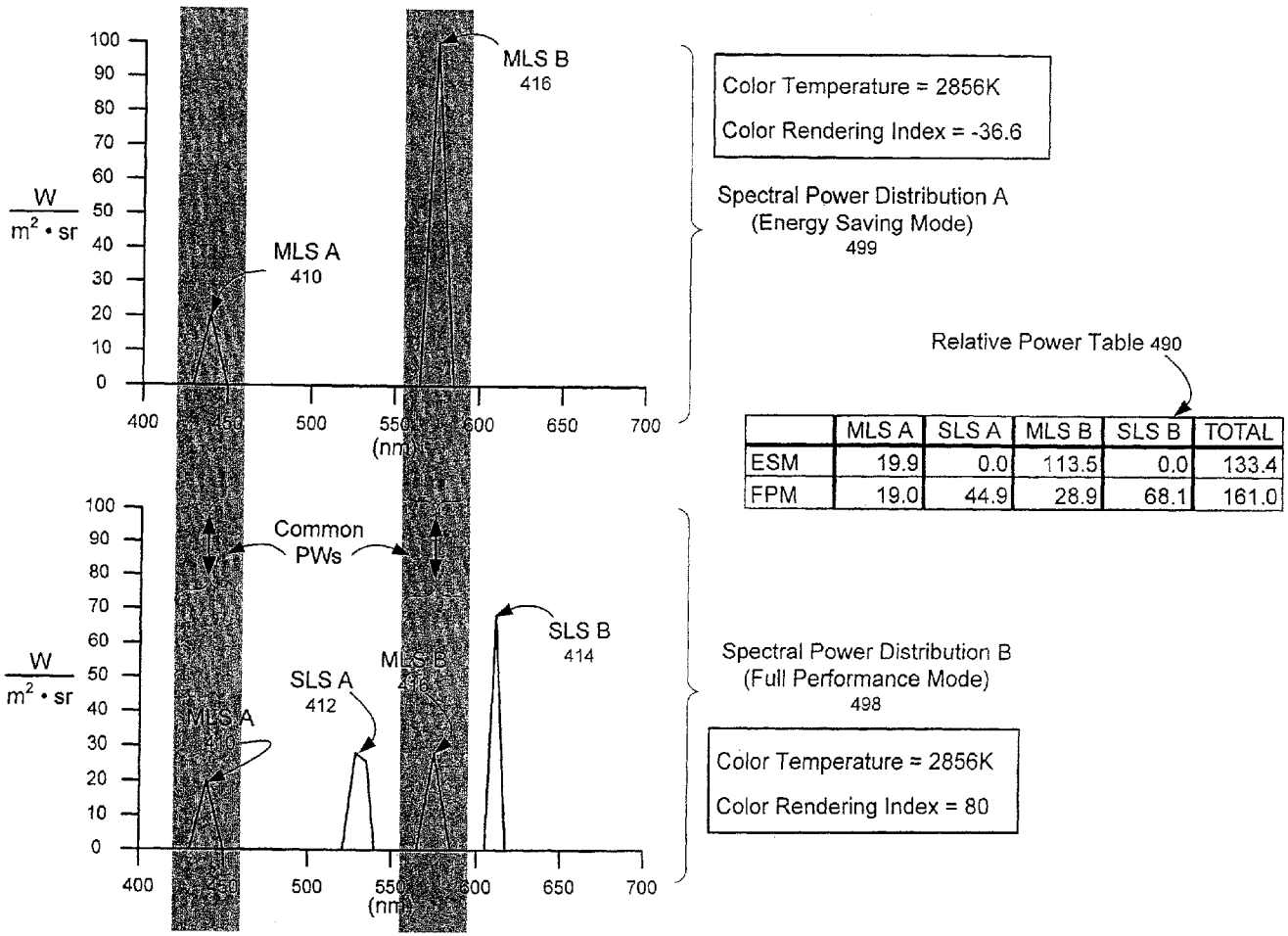
FIGS. 4A, 4B, and 4C show examples in accordance with one or more embodiments of the invention.

FIG. 4A shows an example in accordance with one or more embodiments of the invention. As shown in FIG. 4A, two SPDs (i.e., SPD A (499) an SPD B (498)) have been generated for a CT of 2856 K. SPD A (499) is for an ESM and thus is generated with an attempt to maximize LER with no regard for CRI (i.e., SPD A (499) corresponds to the low value CRI of −36.6). In contrast, SPD B (498) is for a FPM and thus is generated with the goal of a high value CRI (e.g., 80), at the cost of possibly reducing LER. As shown in FIG. 4A, both SPD A (499) and SPD B (498) are spiky and have multiple peak wavelengths.

Still referring to FIG. 4A, SPD B (498) is generated from SPD A (499). Specifically, SPD B (498) is generated by adding additional peak wavelengths to SPD A (499) and adjusting the relative powers of the peak wavelengths already present in SPD A (499). As a result, SPD A (499) and SPD B (498) share common peak wavelengths (PWs).

A lighting system with a ESM and a FPM may be generated from SPD A (499) and SPD B (498). Specifically, main light sources (i.e., MLS A (410), MLS B (416)) corresponding to the common wavelengths and secondary light sources (SLS A (412), SLS B (414)) corresponding to the remaining peak wavelengths are selected for the lighting system. In order to operate the lighting system in the ESM, the main light sources (410, 416) are activated and set to the relative powers dictated by SPD A (499). In order to operate the lighting system in the FPM, both the main light sources (410, 416) and the secondary light sources (412, 414) are activated and set to the relative powers dictated by SPD B (498).

FIG. 4A also shows a relative power table (490) listing the relative power of each light source of the lighting system in both the ESM and the FPM. As shown in relative power table (490), the ESM consumes approximately 17% less energy than the FPM.

Figure 4B:
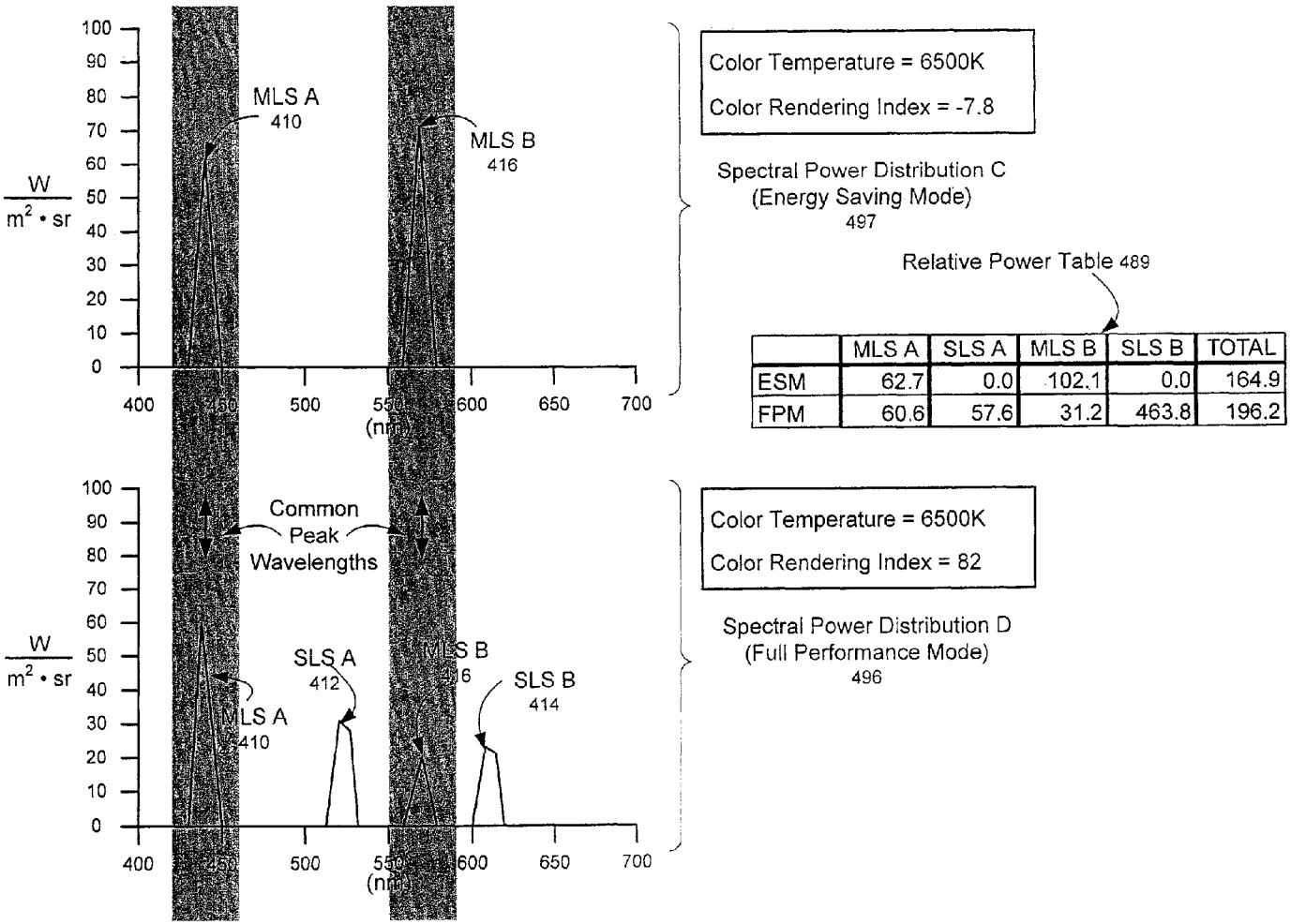

FIG. 4B shows an example in accordance with one or more embodiments of the invention. As shown in FIG. 4B, two SPDs (i.e., SPD C (497) an SPD D (496)) have been generated for a CT of 6500 K. SPD C (497) is for an ESM and thus is generated with an attempt to maximize LER with no regard for CRI (i.e., SPD C (497) corresponds to the low value CRI of −7.8). In contrast, SPD D (496) is for a FPM and thus is generated with the goal of a high value CRI (e.g., 82), at the cost of reducing LER. As shown in FIG. 4B, both SPD C (497) and SPD D (496) are spiky and have multiple peak wavelengths.

Still referring to FIG. 4B, SPD D (496) is generated from SPD C (497). Specifically, SPD D (496) is generated by adding additional peak wavelengths to SPD C (497) and adjusting the relative powers of the peak wavelengths already present in SPD C (497). As a result, SPD C (497) and SPD D (496) share common peak wavelengths (PWs).

A lighting system with a ESM and a FPM may be generated from SPD C (497) and SPD D (496). Specifically, main light sources (i.e., MLS A (410), MLS B (416)) corresponding to the common wavelengths and secondary light sources (SLS A (412), SLS B (414)) corresponding to the remaining peak wavelengths are selected for the lighting system. In order to operate the lighting system in the ESM, the main light sources (410, 416) are activated and set to the relative powers dictated by SPD C (497). In order to operate the lighting system in the FPM, both the main light sources (410, 416) and the secondary light sources (412, 414) are activated and set to the relative powers dictated by SPD D (496).

FIG. 4B also shows a relative power table (489) listing the relative power of each light source of the lighting system in both the ESM and the FPM. As shown in relative power table (490), the ESM consumes approximately 16% less energy than the FPM.

Figure 4C:
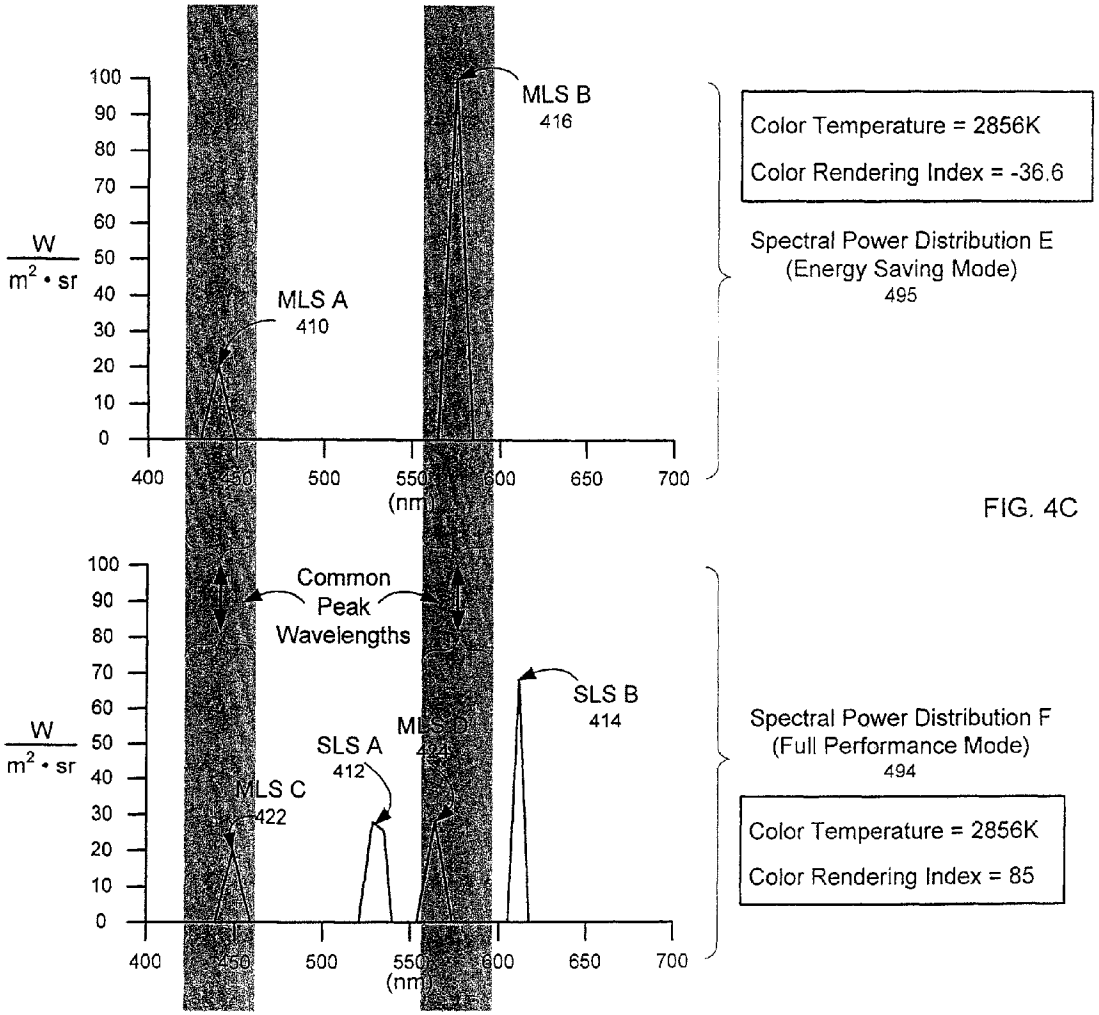

FIG. 4C shows an example in accordance with one or more embodiments of the invention. As shown in FIG. 4C, two SPDs (i.e., SPD E (495) an SPD F (494)) have been generated for a CT of 2856 K. SPD E (495) is for an ESM and thus is generated with an attempt to maximize LER with no regard for CRI (i.e., SPD E (495) corresponds to the low value CRI of −36.6). In contrast, SPD F (494) is for a FPM and thus is generated with the goal of a high value CRI (e.g., 85), at the cost of a lower LER. As shown in FIG. 4C, both SPD E (495) and SPD F (494) are spiky and have multiple peak wavelengths.

Still referring to FIG. 4C, SPD E (495) and SPD F (494) are generated independently. Accordingly, unlike the examples in FIG. 4A and FIG. 4B, SPD E (495) and SPD F (494) do not share any identical peak wavelengths. However, SPD E (495) and SPD F (494) do have peak wavelengths that are sufficiently close to be identified as common peak wavelengths.

A lighting system with a ESM and a FPM may be designed/generated from SPD E (495) and SPD F (494). Specifically, main light sources corresponding to SPD E (495) (i.e., MLS A (410), MLS B (416)) or main light sources corresponding to SPD F (494) (i.e., MLS C (422), MLS D (424)) are selected for the lighting system. Further, the secondary light sources (SLS A (412), SLS B (414)) corresponding to the remaining peak wavelengths are selected for the lighting system. In order to operate the lighting system in the ESM, the main light sources are activated and set to the relative powers dictated by SPD E (495) or SPD F (494). In order to operate the lighting system in the FPM, both the main light sources (410, 416) are activated and set to the relative powers dictated by SPD D (496). It may be necessary to introduce an auxiliary light or adjust the amplitude of each spike to adjust/correct any changes in chromaticity.

Embodiments of the invention have one or more of the following advantages: the ability to reduce energy consumption of a lighting system by operating the lighting system in two or more modes; the ability to operate a lighting system in two or more modes having vastly different CRI values but similar LER values and illuminance; the ability to design lighting systems from multiple SPDs; the ability to generate a SPD corresponding to a high value CRI from a SPD corresponding to a low value CRI; the ability to generate a SPD corresponding to a low value CRI from a SPD corresponding to a high value CRI; the ability to design a lighting system for a CT selected by a user; etc.

Figure 5:
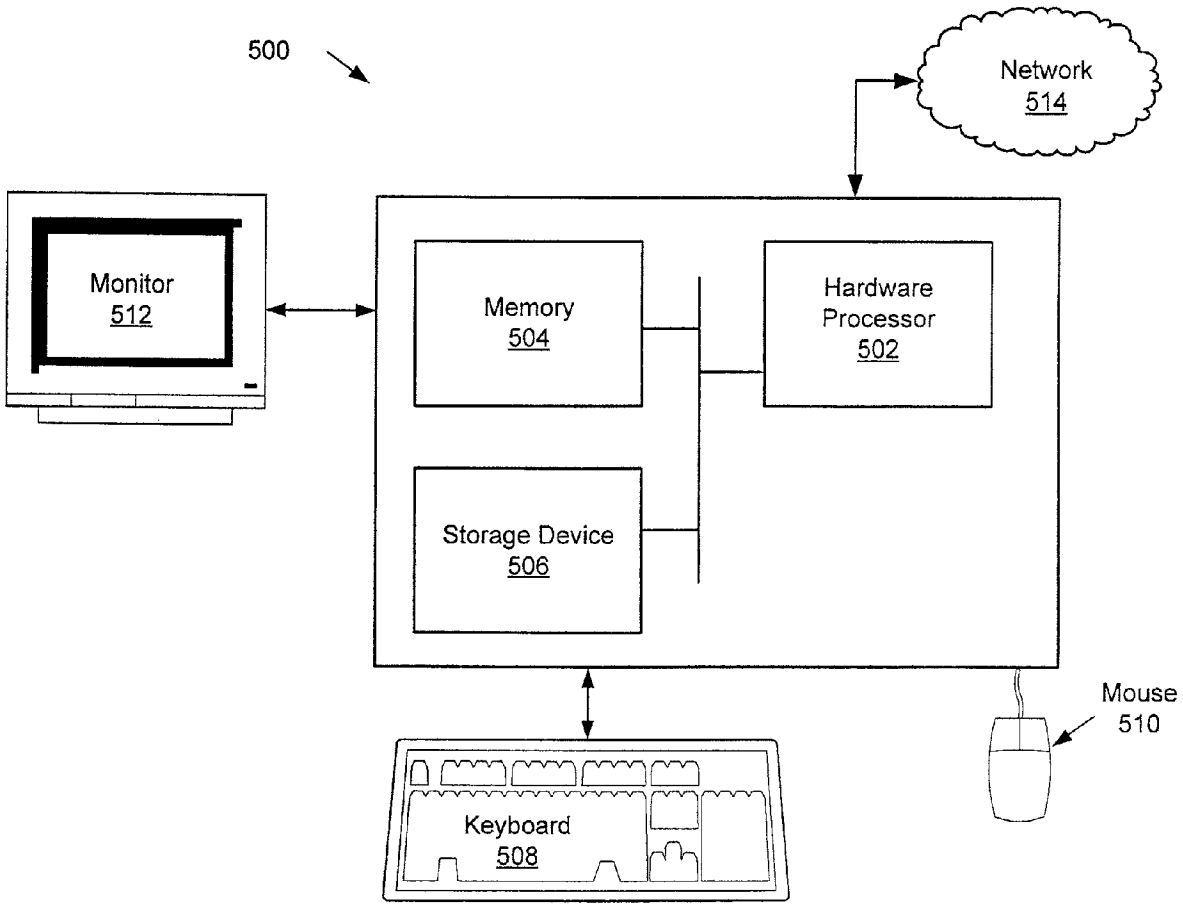
FIG. 5 shows a computer system in accordance with one or more embodiments of the invention.

Embodiments of the invention may be implemented on virtually any type of computer regardless of the platform being used. For example, as shown in FIG. 5, a computer system (500) includes one or more hardware processor(s) (502) (such as a central processing unit (CPU), integrated circuit, etc.), associated memory (504) (e.g., random access memory (RAM), cache memory, flash memory, etc.), a storage device (506) (e.g., a hard disk, an optical drive such as a compact disk drive or digital video disk (DVD) drive, a flash memory stick, etc.), and numerous other elements and functionalities typical of today's computers (not shown). The computer system (500) may also include input means, such as a keyboard (508), a mouse (510), or a microphone (not shown). Further, the computer system (500) may include output means, such as a monitor (512) (e.g., a liquid crystal display (LCD), a plasma display, or cathode ray tube (CRT) monitor). The computer system (500) may be connected to a network (514) (e.g., a local area network (LAN), a wide area network (WAN), the Internet, or any other type of network) via a network interface connection (not shown). Those skilled in the art will appreciate that many different types of computer systems exist, and the aforementioned input and output means may take other forms. Generally speaking, the computer system (500) includes at least the minimal processing, input, and/or output means necessary to practice embodiments of the invention.

Further, in one or more embodiments of the invention, one or more elements of the aforementioned computer system (500) may be located at a remote location and connected to the other elements over a network. Further, embodiments of the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor or micro-core of a processor with shared memory and/or resources. Further, software instructions in the form of computer readable program code to perform embodiments of the invention may be stored, temporarily or permanently, on a non-transitory computer readable storage medium, such as a compact disc (CD), a diskette, a tape, a hard drive, punch cards, memory, or any other tangible computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for designing a lighting system, comprising:

obtaining a selection of a color temperature (CT);

obtaining, for the CT, a first spectral power distribution (SPD) corresponding to a low value color rendering index (CRI) and comprising a first plurality of peak wavelengths;

obtaining, for the CT, a second SPD corresponding to a high value CRI and comprising a second plurality of peak wavelengths; and identifying a plurality of common peak wavelengths shared by the first SPD and the second SPD, wherein the lighting system comprises a first plurality of light sources corresponding to the plurality of common peak wavelengths and a second plurality of light sources corresponding to a plurality of remaining peak wavelengths of the second plurality of peak wavelengths, wherein the first plurality of light sources comprises:

a long-wavelength side first light source corresponding to a peak wavelength on longer wavelength side among the plurality of common peak wavelengths; and a short-wavelength side first light source corresponding to a peak wavelength on shorter wavelength side among the plurality of common peak wavelengths, wherein the second plurality of light sources comprises:

a short-wavelength side second light source corresponding to a wavelength which is between the peak wavelength corresponding to the long-wavelength side first light source and the peak wavelength corresponding to the short-wavelength side first light source; and a long-wavelength side second light source corresponding to a longer peak wave wavelength than the peak wavelength corresponding to the long-wavelength side first light source, and wherein the lighting system activates the second plurality of light sources in response to an event.

2. The method of claim 1, wherein obtaining the second SPD comprises:

generating, by simulation, the first SPD for the CT, wherein the first plurality of peak wavelengths comprises a plurality of relative powers; and generating, by simulation, the second SPD corresponding to the high value CRI by adding the remaining peak wavelengths to the first SPD and adjusting the plurality of powers of the first plurality of peak wavelengths.

3. The method of claim 2, wherein the CT is selected from a range of 2500K-3000K, and wherein the first SPD has a maximum luminous efficacy of radiation for the CT.

4. The method of claim 1, wherein obtaining the first SPD comprises:

obtaining a selection of the high value CRI;

generating, by simulation, the second SPD for the CT and corresponding to the high value CRI, wherein the second plurality of peak wavelengths comprises a plurality of relative powers; and generating, by simulation, the first SPD by removing the remaining peak wavelengths from the second SPD and adjusting the plurality of relative powers of the second plurality of peak wavelengths.

5. The method of claim 4, wherein the high value CRI is equal to 80 or exceeds 80.

6. The method of claim 1, wherein the event is at least one selected from a group consisting of motion within a volume of space and a timer timeout.

7. A non-transitory computer readable medium storing instruction for designing a lighting system, the instructions comprising functionality to:

obtain a selection of a color temperature (CT);

obtain, for the CT, a first spectral power distribution (SPD) corresponding to a low value color rendering index (CRI) and comprising a first plurality of peak wavelengths;

obtain, for the CT, a second SPD corresponding to a high value CRI and comprising a second plurality of peak wavelengths; and identify a plurality of common peak wavelengths shared by the first SPD and the second SPD, wherein the lighting system comprises a first plurality of light sources corresponding to the plurality of common peak wavelengths and a second plurality of light sources corresponding to a plurality of remaining peak wavelengths of the second plurality of peak wavelengths, wherein the first plurality of light sources comprises:

a long-wavelength side first light source corresponding to a peak wavelength on longer wavelength side among the plurality of common peak wavelengths; and a short-wavelength side first light source corresponding to a peak wavelength on shorter wavelength side among the plurality of common peak wavelengths, wherein the second plurality of light sources comprises:

a short-wavelength side second light source corresponding to a wavelength which is between the peak wavelength corresponding to the long-wavelength side first light source and the peak wavelength corresponding to the short-wavelength side first light source; and a long-wavelength side second light source corresponding to a longer peak wave wavelength than the peak wavelength corresponding to the long-wavelength side first light source, and wherein the lighting system activates the second plurality of light sources in response to an event.

8. The non-transitory computer readable medium of claim 7, wherein the instructions to obtain the second SPD comprise functionality to:

generate, by simulation, the first SPD for the CT, wherein the first plurality of peak wavelengths comprises a plurality of relative powers; and generate, by simulation, the second SPD corresponding to the high value CRI by adding the remaining peak wavelengths to the first SPD and adjusting the plurality of powers of the first plurality of peak wavelengths.

9. The non-transitory computer readable medium of claim 8, wherein the CT is selected from a range of 2500K-3000K, and wherein the first SPD has a maximum luminous efficacy of radiation for the CT.

10. The non-transitory computer readable medium of claim 7, wherein the instructions to obtain the first SPD comprise functionality to:

obtain a selection of the high value CRI;

generate, by simulation, the second SPD for the CT and corresponding to the high value CRI, wherein the second plurality of wavelengths comprises a plurality of relative powers; and generate, by simulation, the first SPD by removing the remaining peak wavelengths from the second SPD and adjusting the plurality of relative powers of the second plurality of peak wavelengths.

11. A method for controlling light sources, comprising:

activating a first plurality of light sources corresponding to a first plurality of peak wavelengths;

detecting an event; and activating, in response to detecting the event, a second plurality of light sources corresponding to a second plurality of peak wavelengths, wherein the first plurality of peak wavelengths are common peak wavelengths shared by a first spectral power distribution (SPD) corresponding to a low value color rendering index (CRI) and a second SPD corresponding to a high value CRI, wherein the first SPD and the second SPD are for the same color temperature (CT), wherein the second SPD comprises the first plurality of peak wavelengths and the second plurality of peak wavelengths, and wherein the second plurality of peak wavelengths comprises:

a short-wavelength side second peak wavelength which is between a first peak wavelength on longer wavelength side among the first plurality of peak wavelengths and a first peak wavelength on shorter wavelength side among the first plurality of peak wave1engths and a long-wavelength side second peak wavelength which is longer than the first peak wavelength on longer wavelength side among the first plurality of peak wavelengths.

12. The method of claim 11, further comprising:

adjusting a plurality of relative powers of the first plurality of light sources in response to the event.

13. The method of claim 11, wherein the first spectral distribution comprises a maximum luminous efficacy of radiation for the low value CRI and the CT.

14. The method of claim 11, wherein the high value CRI is equal to 80 or exceeds 80.

15. A lighting system, comprising:

a first plurality of light sources corresponding to a first plurality of peak wavelengths;

a second plurality of light sources corresponding to a second plurality of peak wavelengths; and a controller unit configured to activate the first plurality of light sources and further configured to activate the second plurality of light sources in response to an event, wherein the first plurality of peak wavelengths are common peak wavelengths shared by a first spectral power distribution (SPD) corresponding to a low value color rendering index (CRI) and a second SPD corresponding to a high value CRI, wherein the first SPD and the second SPD are for the same color temperature (CT), wherein the second SPD comprises the first plurality of peak wavelengths and the second plurality of peak wavelengths, and wherein the second plurality of peak wavelengths comprises:

a short-wavelength side second peak wavelength which is between a first peak wavelength on longer wavelength side among the first plurality of peak wavelengths and a first peak wavelength on shorter wavelength side among the first plurality of peak wave1engths and a long-wavelength side second peak wavelength which is longer than the first peak wavelength on longer wavelength side among the first plurality of peak wavelengths.

16. The lighting system of claim 15, further comprising:

an auxiliary light source to adjust chromaticity.

17. The lighting system of claim 15, wherein the first plurality of light sources comprises at least one selected from a group consisting of a light emitting diode (LED), a laser, an organic light emitting diode (OLED), an OLED with quantum dots, a microcavity, an interference filter, a grating, and a prism.

18. The lighting system of claim 15, wherein the event is at least one selected from a group consisting of motion within a volume of space and a timer timeout.

19. The lighting system of claim 15, wherein the CT is selected from a range of 2500K-3000K, and wherein the first SPD comprises a maximum luminous efficacy of radiation for the CT.

20. The lighting system of claim 15, wherein the high value CRI is equal to 80 or exceeds 80.

* * * * *